US007938502B2

(12) United States Patent
Tojo et al.

(10) Patent No.: US 7,938,502 B2
(45) Date of Patent: May 10, 2011

(54) FLUSHING METHOD FOR FLUID EJECTING DEVICE AND FLUID EJECTING DEVICE

(75) Inventors: Seiji Tojo, Shiojiri (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 445 days.

(21) Appl. No.: 12/234,048

(22) Filed: Sep. 19, 2008

(65) Prior Publication Data

US 2009/0073214 A1 Mar. 19, 2009

(30) Foreign Application Priority Data

Sep. 19, 2007 (JP) ..... 2007-242467
Dec. 5, 2007 (JP) ..... 2007-315017

(51) Int. Cl.
*B41J 29/393* (2006.01)

(52) U.S. Cl. ..... 347/19; 347/55; 347/81

(58) Field of Classification Search ..... 347/14, 347/19, 22, 23, 35, 36, 37, 52, 55, 81, 89, 347/90

See application file for complete search history.

(56) References Cited

U.S. PATENT DOCUMENTS 6,561,614 B1 * 5/2003 Therien et al. ..... 347/19
2003/0020777 A1 * 1/2003 Su et al. ..... 347/19

FOREIGN PATENT DOCUMENTS

JP 10-181047 7/1998
JP 2001-277543 10/2001
JP 2006-123499 5/2006

* cited by examiner

*Primary Examiner* — Thinh H Nguyen
(74) *Attorney, Agent, or Firm* — Workman Nydegger

(57) ABSTRACT

There is provided a flushing method for a fluid ejecting device that prevents clogging of a nozzle by ejecting a fluid of a set number of droplets at each set time interval in a fluid ejecting process from the nozzle of a fluid ejecting head toward a fluid receiving part that is disposed to face a nozzle opening face of the fluid ejecting head in a state of non-contacting the nozzle opening face. The flushing method includes applying an electric field between the nozzle opening face and the fluid receiving part, ejecting the fluid from the fluid ejecting head toward the fluid receiving part, detecting a voltage change based on electrostatic induction that occurs at a time when the fluid is ejected toward the fluid receiving part, and changing one between the set time interval and the set number of the droplets based on the voltage change.

18 Claims, 11 Drawing Sheets

FIG. 11

| RESULT OF COMPARISON (DIFFERENCE RATIO) | SMALLER THAN 5% | EQUAL TO OR LARGER THAN 5% AND SMALLER THAN 10% | EQUAL TO OR LARGER THAN 10% |
|---|---|---|---|
| TIME INTERVAL OF REGULAR FLUSHING PROCESS (SET TIME INTERVAL) | EXTENDED BY 0.5 SECOND | NO CHANGE | SHORTENED BY 0.5 SECOND |
| NUMBER OF EJECTED DROPLETS (NUMBER OF SET DROPLETS) | DECREASE BY ONE DROPLET | NO CHANGE | INCREASE BY ONE DROPLET |

FLUSHING METHOD FOR FLUID EJECTING DEVICE AND FLUID EJECTING DEVICE

BACKGROUND

1. Technical Field

The present invention relates to a flushing method for a fluid ejecting device such as an ink jet printer and a fluid ejecting device.

2. Related Art

Fluid ejecting devices have fluid ejecting heads that can eject fluids as liquid droplets and eject various fluids from the fluid ejecting heads.

As a typical example of the fluid ejecting device, there is an image recording device such as an ink jet printer that includes an ink jet record head (hereinafter, simply referred to as a record head) as a fluid ejecting head and performs a recording process by forming dots by ejecting ink having a fluid shape from nozzles (openings) of the record head as ink droplets toward a ejection target such as a recording sheet and landing the ink in the ejection target.

In addition, recently, application of the fluid ejecting device is not limited to the image recording device, and the fluid ejecting device is applied to various manufacturing devices such as a color filter manufacturing device used in a liquid crystal display or the like.

In the above-described image recording device, ink stored in a fluid storing unit such as an ink tank or an ink cartridge is introduced into a pressure chamber of the record head, and a pressure generating source such as a piezoelectric vibrator is driven by applying a driving signal to the piezoelectric vibrator. Accordingly, a pressure change is generated in the ink inside the pressure chamber, and ink droplets are ejected from the nozzles by controlling the pressure change.

The record head is configured to increase or decrease the liquid amount (the weight or volume) of the ink droplets ejected from the nozzles in accordance with a driving voltage value (an electric potential difference from a lowest voltage value to a highest voltage value) or a waveform of the driving signal supplied to the pressure generating source.

In addition, in the fluid ejecting device, a flushing process in which ink having increased viscosity inside the nozzles and the like are ejected by ejecting ink from the nozzles before start of a recording (printing) process, in the middle of the recording process, after completion of the recording process, or the like is performed for preventing loss of the dots by appropriately maintaining the states of the nozzles of the record head and ejecting ink droplets of a desired liquid amount all the time.

JP-A-10-181047, JP-A-2001-277543, JP-A-2006-123499 are examples of related art.

In general technology, generally, a regular flushing process that is performed regularly in the middle of a recording (printing) process is performed at predetermined time intervals (for example, a time interval of 10 seconds). In such a case, the number of ejections (for example, several tens of times) is set in advance such that ink having increased viscosity can be removed even in a worst condition (for example, high temperature and low humidity of 40 degrees centigrade (° C.) and 10 percent (%)) that can be supposed based on the use environment.

Thus, even in a case where the ink scarcely has increased viscosity, ink droplets are ejected unnecessarily. Accordingly, there is a problem that a lot of ink is wasted and the efficiency of the recording process decreases.

SUMMARY

An advantage of some aspects of the invention is that it provides a flushing method for a fluid ejecting device and a fluid ejecting device capable of optimizing the frequency of the regular flushing process and the like.

In a flushing method for a fluid ejecting device and a fluid ejecting device according to some aspects of the invention, the following means are employed.

According to a first aspect of the invention, there is provided a flushing method for a fluid ejecting device that prevents clogging of a nozzle by ejecting a fluid of a set number of droplets at each set time interval in a fluid ejecting process from the nozzle of a fluid ejecting head toward a fluid receiving part that is disposed to face a nozzle opening face of the fluid ejecting head in a state of non-contacting the nozzle opening face. The flushing method includes: applying an electric field between the nozzle opening face and the fluid receiving part; ejecting the fluid from the fluid ejecting head toward the fluid receiving part; detecting a voltage change based on electrostatic induction that occurs at a time when the fluid is ejected toward the fluid receiving part; and changing one between the set time interval and the set number of the droplets based on the voltage change.

According to the aspect above, when the viscosity of the fluid ejected from the nozzle changes, so-called a regular flushing process optimized to the viscosity of the fluid can be performed by changing the time interval (frequency) of the regular flushing process and the number of fluid ejections in the regular flushing process. Accordingly, it is possible to suppress unnecessary ejection of the fluid and improve the throughput of the fluid ejecting process for a fluid ejection target.

In the above-described flushing method, the changing of one between the set time interval and the set number of the droplets may include comparing a reference voltage waveform that is detected at a time when the fluid not having increased viscosity are ejected with a detected voltage waveform that is acquired by the detecting of the voltage change.

In such a case, the state of increased viscosity of the fluid ejected from the nozzle can be detected.

In the above-described flushing method, at least one of a highest voltage value, a time interval from ejection of the fluid to generation of the voltage change, and a time interval from the generation of the voltage change to reaching the highest voltage value may be compared in the comparing of the reference voltage waveform with the detected voltage waveform.

In such a case, the state of increased viscosity of the fluid ejected from the nozzle can be detected more assuredly.

In the above-described flushing method, the changing of one between the set time interval and the set number of the droplets may include changing at least one between the set time interval and the set number of the droplets in accordance with a ratio acquired from the comparing of the reference voltage waveform with the detected voltage waveform.

In such a case, an optimized regular flushing process can be implemented.

In the above-described flushing method, when the acquired ratio is lower than a supposed ratio, at least one between the set time interval and the set number of the droplets may be changed such that the set time interval is lengthened and the set number of the droplets is decreased. In such a case, when the acquired ratio is higher than the supposed ratio, at least one between the set time interval and the set number of the droplets may be changed such that the set time interval is shortened and the set number of the droplets is increased.

In such a case, the state of viscosity of the fluid ejected from the nozzle can be maintained to be the same as or lower than the viscosity of supposed viscosity.

In the above-described flushing method, a nozzle that has not ejected a fluid after a previous flushing process or nozzles disposed on both ends of each of a plurality of nozzle rows may be used as the nozzle that ejects the fluid toward the fluid receiving part in the ejecting of the fluid.

In such a case, a nozzle in which the viscosity of the fluid can be easily increased becomes a reference, and accordingly, nozzle clogging can be prevented more assuredly.

In the above-described flushing method, when the changing of one between the set time interval and the set number of the droplets is performed a plurality of times and detection results acquired in the changing of one between the set time interval and the set number of the droplets become approximately fixed, a frequency of performing the applying of the electric field to the changing of one between the set time interval and the set number of the droplets may be decreased.

In such a case, it is possible to suppress the amount of the wasted fluid and improve the throughput of the fluid ejecting process for a fluid ejection target.

In the above-described flushing method, before the ejecting of the fluid, it may be configured that an electric field is applied between the nozzle opening face and the fluid receiving part, the fluid is ejected from the fluid ejecting head toward the fluid receiving part while a time from the previous flushing process is measured, a voltage change caused by electrostatic induction that occurs at a time when the fluid is ejected toward the fluid receiving part is detected, a time interval until the fluid ejected from the fluid ejecting head becomes predetermined viscosity is detected based on the voltage change, and the acquired time interval is set as the set time interval.

In such a case, the set time interval can be set to an optimized value from the start of the fluid ejecting process.

In the above-described flushing method, in the ejecting of the fluid from the fluid ejecting head toward the fluid receiving part, the fluid may be sequentially ejected from nozzles of the fluid ejecting head at different timings.

In such a case, before the fluid ejecting process, optimized setting of the set time interval can be made in a short time.

According to a second aspect of the invention, there is provided a fluid ejecting device that performs a flushing process for preventing clogging of a nozzle by ejecting a fluid of a set number of droplets at each set time interval in a fluid ejecting process from the nozzle of a fluid ejecting head toward a fluid receiving part that is disposed to face a nozzle opening face of the fluid ejecting head in a state of non-contacting the nozzle opening face. The fluid ejecting device includes: a fluid detecting unit that applies an electric field between the nozzle opening face and the fluid receiving part and detects a voltage change based on electrostatic induction that occurs at a time when the fluid is ejected toward the fluid receiving part; and a flushing processing unit that ejects the fluid from the fluid ejecting head toward the fluid receiving part and changes one between the set time interval and the set number of the droplets based on the detection result of the fluid detecting unit.

According to the aspect above, when the viscosity of the fluid ejected from the nozzle changes, so-called a regular flushing process optimized to the viscosity of the fluid can be performed by changing the time interval (frequency) of the regular flushing process and the number of fluid ejections in the regular flushing process. Accordingly, it is possible to suppress unnecessary ejection of the fluid and improve the throughput of the fluid ejecting process for a fluid ejection target.

In the above-described fluid ejecting device, the flushing processing unit may compare a reference voltage waveform that is detected by the fluid receiving part at a time when the fluid having non-increased viscosity is ejected from the fluid ejecting head and a detected voltage waveform that is detected at a time when the fluid having increased viscosity is ejected.

In such a case, the state of increased viscosity of the fluid ejected from the nozzle can be detected.

In the above-described fluid ejecting device, the flushing processing unit may compare at least one of a highest voltage value, a time interval from ejection of the fluid to generation of the voltage change, and a time interval from the generation of the voltage change to reaching the highest voltage value.

In such a case, the state of increased viscosity of the fluid ejected from the nozzle can be detected more assuredly.

In the above-described fluid ejecting device, the flushing processing unit may change at least one between the set time interval and the set number of the droplets in accordance with an acquired ratio.

In such a case, an optimized regular flushing process can be implemented.

In the above-described fluid ejecting device, it may be configured that the flushing processing unit changes at least one between the set time interval and the set number of the droplets such that the set time interval is lengthened and the set number of the droplets is decreased when the acquired ratio is lower than a supposed ratio, and the flushing processing unit changes at least one between the set time interval and the set number of the droplets such that the set time interval is shortened and the set number of the droplets is increased when the acquired ratio is higher than the supposed ratio.

In such a case, the state of viscosity of the fluid ejected from the nozzle can be maintained to be the same as or lower than the viscosity of supposed viscosity.

In the above-described fluid ejecting device, a nozzle that has not ejected a fluid after a previous flushing process or nozzles disposed on both ends of each of a plurality of nozzle rows may be used as the nozzle that ejects the fluid toward the fluid receiving part.

In such a case, a nozzle in which the viscosity of the fluid can be easily increased becomes a reference, and accordingly, nozzle clogging can be prevented more assuredly.

In the above-described fluid ejecting device, the flushing processing unit may decrease a frequency of operating the fluid detecting unit when a plurality of acquired detection results becomes approximately fixed.

In such a case, it is possible to suppress the amount of the wasted fluid and improve the throughput of the fluid ejecting process for a fluid ejection target.

In the above-described fluid ejecting device, the flushing processing unit, before the fluid ejecting process, may eject the fluid from the fluid ejecting head toward the fluid receiving part while measuring a time from the previous flushing process, acquire a time interval until the fluid ejected from the nozzle becomes predetermined viscosity based on the detection result of the fluid detecting unit, and set the acquired time interval as the set time interval.

In such a case, the set time interval can be set to an optimized value from the start of the fluid ejecting process.

In the above-described fluid ejecting device, the flushing processing unit may sequentially eject the fluid from nozzles of the fluid ejecting head at different timings.

In such a case, before the fluid ejecting process, optimized setting of the set time interval can be made in a short time.

BRIEF DESCRIPTION OF THE DRAWINGS

The invention will be described with reference to the accompanying drawings, wherein like numbers reference like elements.

FIG. 9A is a diagram showing a state right after ejection of the ink droplets. FIG. 9B is a diagram showing a state that the ink droplets land in a test area of a cap member.

FIG. 11 is a table showing changed contents of a flushing condition according to an embodiment of the invention.

DESCRIPTION OF EXEMPLARY EMBODIMENTS

Hereinafter, a flushing method for a fluid ejecting device and a fluid ejecting device according to embodiments of the invention will be described with reference to the accompanying drawings.

In the embodiments, an inkjet ejecting printer (hereinafter, referred to as a printer 1) will be described as an example of a fluid ejecting device according to the invention.

Figure 1:
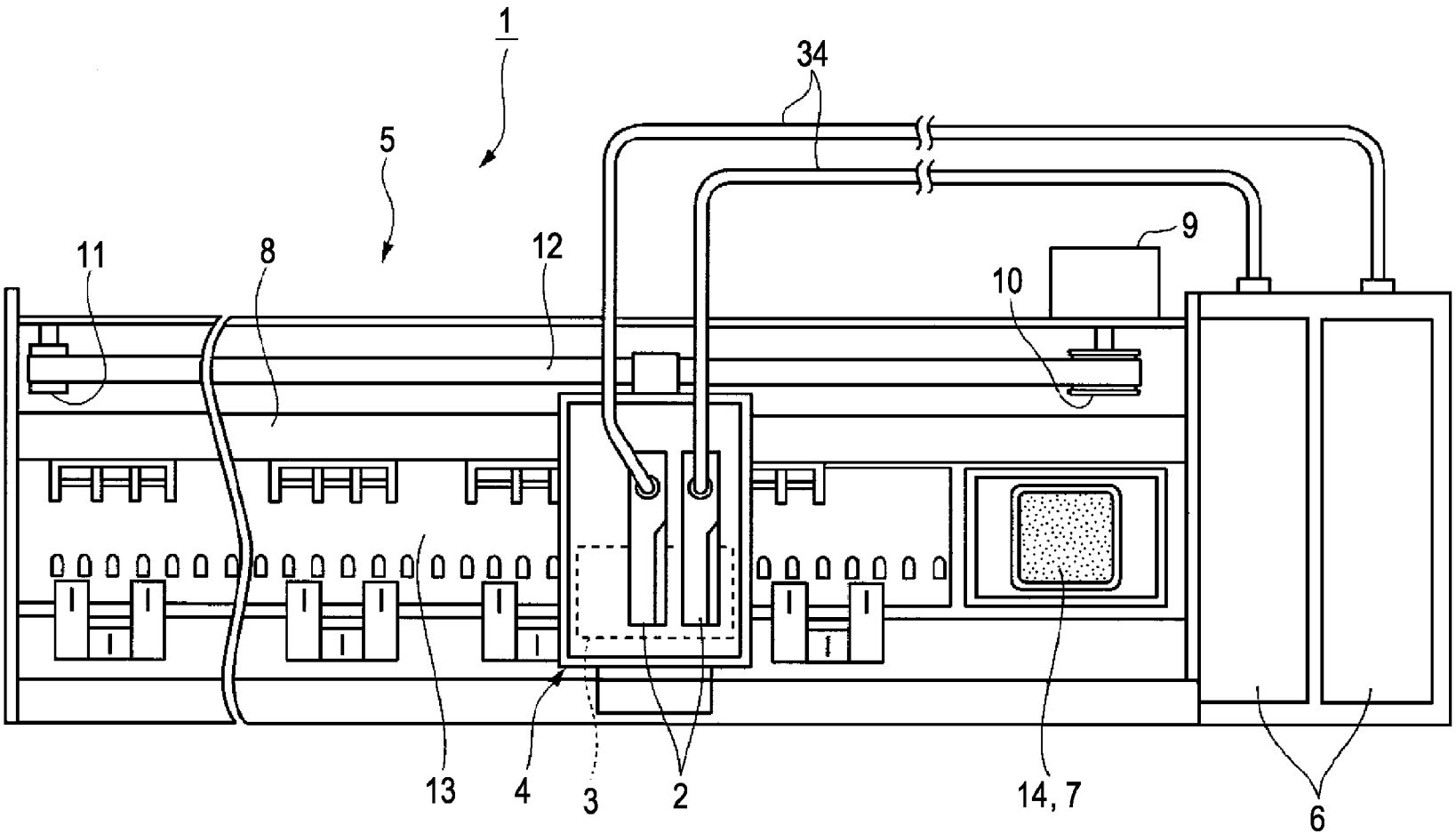
FIG. 1 is a diagram showing the configuration of a printer according to an embodiment of the invention.

FIG. 1 is a partial exploded view showing a schematic configuration of a printer 1 according to an embodiment of the invention.

The printer 1 includes a carriage 4, in which a sub tank 2 and a record head 3 are loaded, and a printer main body 5.

In the printer main body 5, a carriage moving mechanism 65 (see FIG. 5) that reciprocates the carriage 4, a paper transporting mechanism 66 (see FIG. 5) that transports a recording sheet (a target for fluid ejection) not shown in the figure, a capping mechanism 14 that is used for a cleaning operation in which ink L having increased viscosity is sucked from nozzles of the record head 3 and the like, and an ink cartridge 6 in which the ink L to be supplied to the record head 3 is stored are provided.

In addition, the printer 1 includes an ink droplet sensor 7 (see FIGS. 4 and 5) that can detect ink droplets D ejected from the record head 3. The ink droplet sensor 7 is configured to charge the ink droplets D ejected from the record head 3 and output a voltage change in accordance with electrostatic induction at a time when the charged ink droplets D fly, as a detected signal.

The ink droplet sensor 7 will be described later in detail.

The carriage moving mechanism 65 is configured by a guide shaft 8 that is installed in the direction of the width of the printer main body 5, a pulse motor 9, a driving pulley 10 that is connected to a rotation shaft of a pulse motor 9 and is rotated by the pulse motor 9, an idling pulley 11 that is disposed on a side opposite to the driving pulley 10 in the width direction of the printer main body 5, and a timing belt 12 that is suspended between the driving pulley 10 and the idling pulley 11 and is connected to the carriage 4.

The carriage 4 is configured to reciprocate in the main scanning direction along the guide shaft 8 by driving the pulse motor 9.

The paper transporting mechanism 66 is configured by a paper transporting motor (not shown), a paper transporting roller (not shown), and the like. The paper transporting mechanism 66 sequentially transports a recording sheet on a platen 13 in accordance with a recording (printing) operation.

The capping mechanism 14 is configured by a cap member 15, a suction pump 16, and the like. The cap member 15 is configured by a member acquired by forming an elastic material such as rubber in a tray shape and is disposed at a home position. The home position is within a movement range of the carriage 4 and is set to an end-part area that is located on the outer side of the recording area. The home position is a place in which the carriage 4 is located in a case where power is turned off or a recording operation (fluid ejecting process) is not performed for a long time.

When the carriage 4 is located at the home position, the cap member 15 is brought into contact with the surface (that is, a nozzle opening face 43*a*) of a nozzle substrate 43 (see FIG. 3) of the record head 3 so as to seal the nozzle substrate. When the suction pump is operated in the sealed state, the pressure of the inside (a sealed vacant part) of the cap member 15 decreases, and accordingly, the ink L inside the record head 3 is forcedly discharged from the nozzle 47.

In addition, the cap member 15 receives ink droplets D in a flushing process in which the ink droplets D are ejected for discharging the ink L having increased viscosity and air bubbles before or during a recording operation performed by the record head 3.

Figure 2:
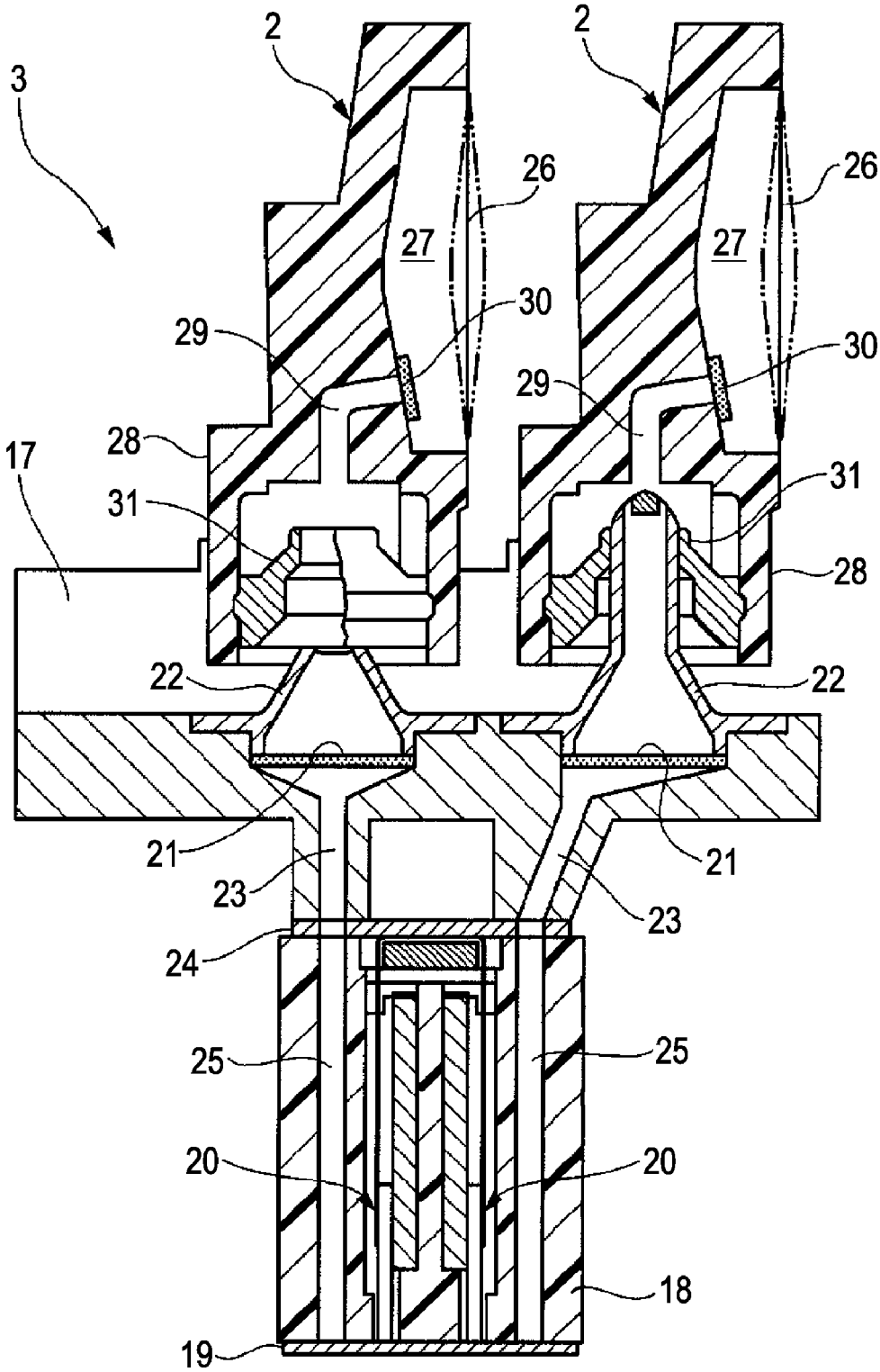
FIG. 2 is a cross-section view showing the configuration of a record head according to an embodiment of the invention.
Figure 3:
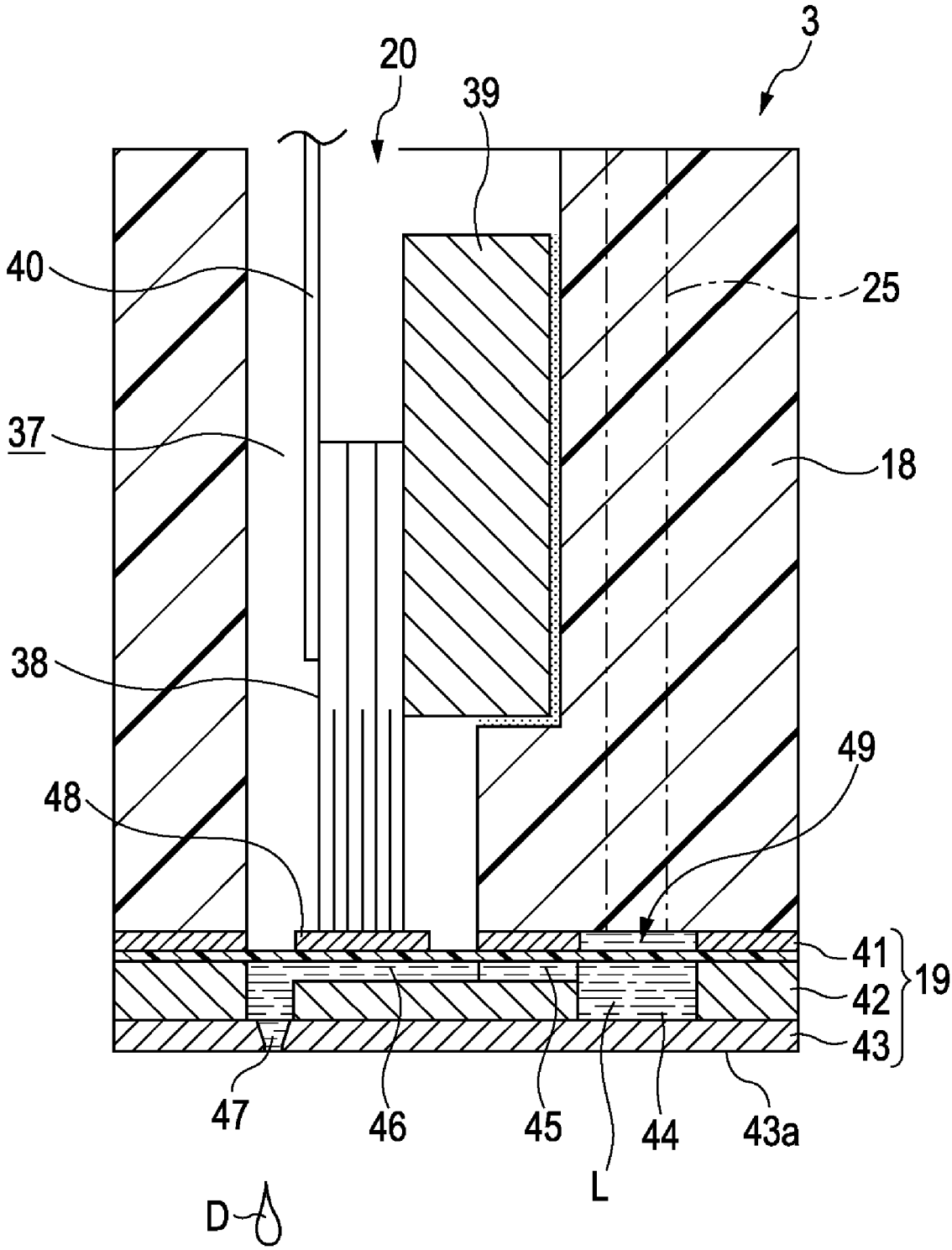
FIG. 3 is a partial cross-section view showing the configuration of the record head.
Figure 4:
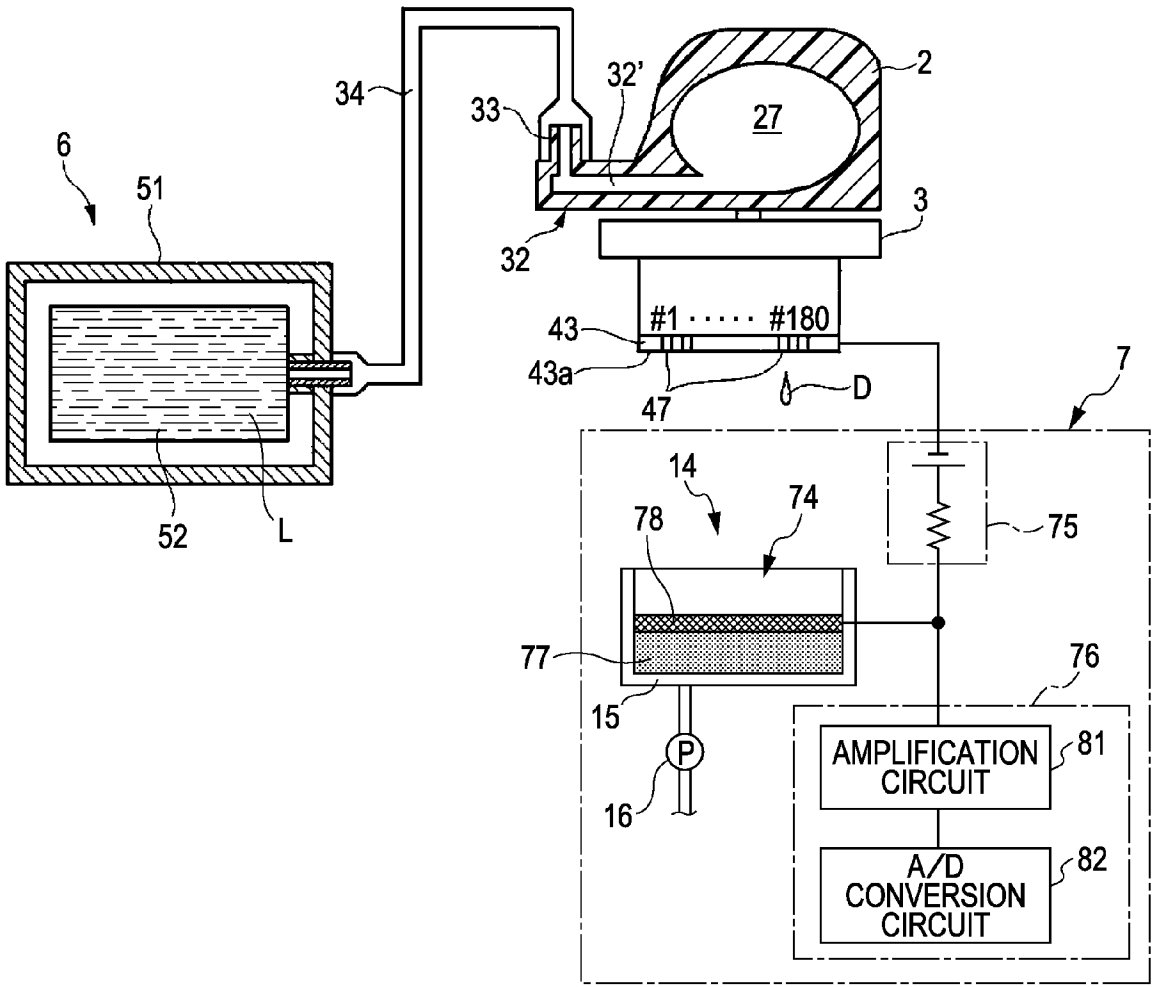
FIG. 4 is a schematic diagram showing the configuration of the record head, an ink cartridge, and an ink droplet sensor according to an embodiment of the invention.

FIG. 2 is a cross-section view showing the configuration of the record head 3. FIG. 3 is a cross section view of major parts of the record head 3. FIG. 4 is a schematic diagram showing the configuration of the record head 3, the ink cartridge 6, and the ink droplet sensor 7.

The record head according to this embodiment has an introduction needle unit 17, a head case 18, a flow path unit 19, and an actuator unit 20 as its major constituent elements.

On the upper face of the introduction needle unit 17, two ink introducing needles 22 are horizontally aligned to be installed in a state that filters 21 are interposed therebetween. To the ink introducing needles 22, sub tanks 2 are installed. In addition, inside the introduction needle unit 17, ink introducing paths 23 corresponding to the ink introducing needles 22 are formed.

The upper end of the ink introducing path 23 is communicated with the corresponding ink introducing needle 22 though the filter 21. In addition, the lower end of the ink introducing paths 23 is communicated with a case flow path 25 that is formed inside the head case 18 through a packing 24.

In this embodiment, two kinds of ink are configured to be used, and thus, two sub tanks 2 are disposed. However, it is apparent that the invention may be applied to a configuration in which three kinds or more of ink are used.

The sub tank 2 is formed by using a resin material such as polypropylene. In the sub tank 2, a concave part that becomes an ink chamber 27 is formed. The ink chamber 27 is partitioned by attaching a transparent elastic sheet 26 to an opening face of the concave part.

In addition, in a lower part of the sub tank 2, a needle connecting part 28 in which the ink introducing needle 22 is inserted is disposed so as to protrude toward the lower side. The ink chamber 27 of the sub tank 2 is in the shape of a mortar having a shallow bottom. In a position slightly below the vertical center of the side of the ink chamber, an upstream opening of the connection flow path 29 that is communicated between the needle connecting part 28 and the ink chamber 27 is disposed. In addition, to the upstream opening, a tank unit filter 30 that filters the ink L is installed.

Into the internal space of the needle connecting part 28, a sealing member 31 into which the ink introducing needle 22 protrudes is inserted. In the sub tank 2, as shown in FIG. 4, an extension part 32 having a communication groove part 32' that is communicated with the ink chamber 27 is formed. In addition, on the top face of the extension part 32, an ink flowing opening 33 protrudes.

To the ink flowing opening 33, an ink supplying tube 34 that supplies the ink L stored in the ink cartridge 6 is connected. Accordingly, the ink L passing through the ink supplying tube 34 passes the ink flowing opening 33 and the communication groove part 32' and flows in the ink chamber 27.

The elastic sheet 26 can be deformed in a direction for contracting or expanding the ink chamber 27. Thus, the change in pressure of the ink L is absorbed by a damper function implemented by deformation of the elastic sheet 26. In other words, by using the operation of the elastic sheet 26, the sub tank 2 serves as a pressure damper. Accordingly, the ink L is supplied to the record head 3 side in a state that the change in the pressure is absorbed inside the sub tank 2.

The head case 18 is a hollow box shaped member formed of a synthetic resin. To the lower end face of the head case, a flow path unit 19 is bonded, and inside a hollow receiving part 37 that is formed inside the head case 18, an actuator unit 20 is housed. Thus, the introduction needle unit 17 is installed to an upper end face of the head case which is located opposite to the flow path unit 19 with a packing 24 interposed therebetween.

Inside the head case 18, a case flow path 25 is formed in the height direction thereof. The upper end of the case flow path 25 is configured to be communicated with the ink introducing path 23 of the introduction needle unit 17 through the packing 24.

In addition, the lower end of the case flow path 25 is communicated with a common ink chamber 44 inside the flow path unit 19. Accordingly, the ink L introduced from the ink introducing needle 22 is supplied to the common ink chamber 44 through the ink introducing path 23 and the case flow path 25.

The actuator unit 20 that is housed inside the hollow receiving part 37 of the head case 18 is configured by a plurality of piezoelectric vibrators 38 that are installed to be aligned in a comb-teeth shape, a fixed plate 39 to which the piezoelectric vibrators 38 are fixed, and a flexible cable 40 as a wiring member that supplies a driving signal from the printer main body side to the piezoelectric vibrators 38. Each piezoelectric vibrator 38 has a fixed end part side bonded to the fixed plate 39 and a free end part side protruding outside of the front end face of the fixed plate 39. In other words, each piezoelectric vibrator 38 is installed to the fixed plate 39 in a cantilevered state.

In addition, the fixed plate 39 that supports the piezoelectric vibrators 38, for example, is formed of stainless steel of a thickness of about 1 mm. The actuator unit 20 is housed in and fixed to the hollow receiving part 37 by bonding the back face of the fixed plate 39 to a case inner wall face that partitions the hollow receiving part 37.

The flow path unit 19 is produced by bonding laminated constituent members of the flow path unit each including a vibration plate (sealing plate) 41, a flow path substrate 42, and a nozzle substrate 43 that are integrated by using an adhesive agent. The flow path unit 19 is a member that forms a series of ink flowing paths (fluid flowing paths) from the common ink chamber 44 through an ink supplying opening 45 and a pressure chamber 46 to the nozzle 47. The pressure chamber 46 is formed as a room that is long and thin in a direction perpendicular to the direction (direction of the row of the nozzles) of alignment of the nozzles 47. In addition, the common ink chamber 44, which is communicated with the case flowing path 25, is a room in which the ink L is introduced from the ink introducing needle 22 side.

Then, the ink L introduced into the common ink chamber 44 is distributed and supplied to the pressure chambers 46 through the ink supplying opening 45.

The nozzle substrate 43 that is disposed on the bottom of the flow path unit 19 is a thin metal board in which a plurality of the nozzles 47 in the shape of a row at a pitch (for example 180 dpi) corresponding to the density of dot formation is established. The nozzle plate 43 according to this embodiment is formed of a stainless steel board. In this embodiment, a total of 22 rows of the nozzles 47 (that is, nozzle rows) corresponding to the sub tanks 2 are installed in parallel with one another. One nozzle row, for example, is configured by 180 nozzles 47 (see FIG. 7).

A flow path substrate 42 disposed between the nozzle substrate 43 and a vibration plate 41 is a plate-shaped member in which a flow path part that becomes the ink flowing path, and more particularly, vacant parts that become the common ink chamber 44, the ink supplying opening 45, and the pressure chamber 46 are formed to be partitioned.

In this embodiment, the flow path substrate 42 is produced by performing an anisotropic etching process for a silicon wafer that is a member having crystalinity. The vibration plate 41 is a double-structured composite board acquired by laminating an elastic film on a support plate formed of metal such as stainless steel. In a part of the vibration plate 41 corresponding to the pressure chamber 46, an island part 48 to which the front end face of the piezoelectric vibrator 38 is bonded is formed by removing the support plate in a circular shape by an etching process or the like. The island part serves as a diaphragm unit. In other words, the vibration plate 41 is configured such that the elastic film on the periphery of the island part 48 is elastically deformed by the operation of the piezoelectric vibrator 38. In addition, the vibration plate 41 also serves as a compliance unit 49 by sealing one opening face of the flow path substrate 42. A part corresponding to the compliance unit 49, as the diaphragm unit, is formed of only the elastic film by removing the support plate by an etching process or the like.

When a driving signal is supplied to the piezoelectric vibrator 38 of the record head 3 through the flexible cable 40, the piezoelectric vibrator 38 is expanded or contracted in the longitudinal direction thereof. Accordingly, the island part 48 is moved in a direction for approaching the pressure chamber 46 or departing from the pressure chamber 46. As a result, the volume of the pressure chamber 46 changes, and therefore, a change of the ink L in the pressure inside the pressure chamber 46 is generated. In accordance with the change in the pressure, ink droplets D are ejected from the nozzle 47.

The ink cartridge 6, as shown in FIG. 4, is configured by a case member 51 formed in a hollow box shape and an ink pack 52 formed of a plastic material. In a housing chamber inside the case member 51, the ink pack 52 is housed.

The ink cartridge 6 is communicated with one end part of the ink supplying tube 34. The ink cartridge 6 is configured to supply the ink L inside the ink pack 52 to the record head 3 side by using a hydraulic head difference between the nozzle opening face 43*a* of the record head 3 and the ink cartridge. In particular, a relative position relationship between the ink cartridge 6 and the record head 3 in the direction of weight is set to be in a state that very weak negative pressure is applied to a meniscus of the nozzle 47.

Then, supply of the ink L to the pressure chamber 46 and ejection of the ink L inside the pressure chamber 46 are performed by using a change in the pressure that is generated by driving the piezoelectric vibrator 38.

The ink droplet sensor 7, as shown in FIG. 4, is configured by a cap member 15 as a unit for receiving ink droplets that is disposed at the home position, a test area 74 that is disposed inside the cap member 15, a voltage applying circuit 75 that applies a voltage between the test area 74 and the nozzle substrate 43 of the record head 3, and a voltage detecting circuit 76 that detects the voltage of the test area 74.

The cap member 15 is a member in a tray shape having an open top face and is formed of an elastic member such as an elastomer. Inside the cap member 15, an ink absorber 77 is disposed. The ink absorber 77 has a high holding force for the ink L and is formed, for example, of a non-woven cloth such as a pelt.

On the top face of the ink absorber 77, an electrode member 78 in a mesh shape is disposed. The surface of the electrode member 78 corresponds to the test area 74. The electrode member 78 is formed as a mesh in a grid shape formed of metal such as stainless steel. Accordingly, the ink droplets D landed on the electrode member 78 are configured to pass a gap of the grid-shaped electrode member 78 and be absorbed and held by the absorber 77 disposed on the lower side.

The voltage applying circuit 75 electrically connects the electrode member 78 and the nozzle substrate 43 of the record head 3 through a DC power source (for example, 400 V) and a resistor (for example 1 MΩ) such that the electrode member 78 becomes a positive electrode and the nozzle substrate 43 becomes a negative electrode.

The voltage detecting circuit 76 includes an amplification circuit 81 that amplifies a voltage signal of the electrode member 78 and outputs the resultant signal and an A/D conversion circuit 82 that performs an A/D conversion process for the signal output from the amplification circuit 81 and outputs the resultant signal to the printer controller 55 side. The amplification circuit 81 is configured to amplify the voltage signal of the electrode member 78 with a predetermined amplification factor and output the resultant signal. In addition, the A/D conversion circuit 82 is configured to convert an analog signal output from the amplification circuit 81 into a digital signal and output the converted digital signal to a printer controller 55 side as a detected signal.

Figure 5:
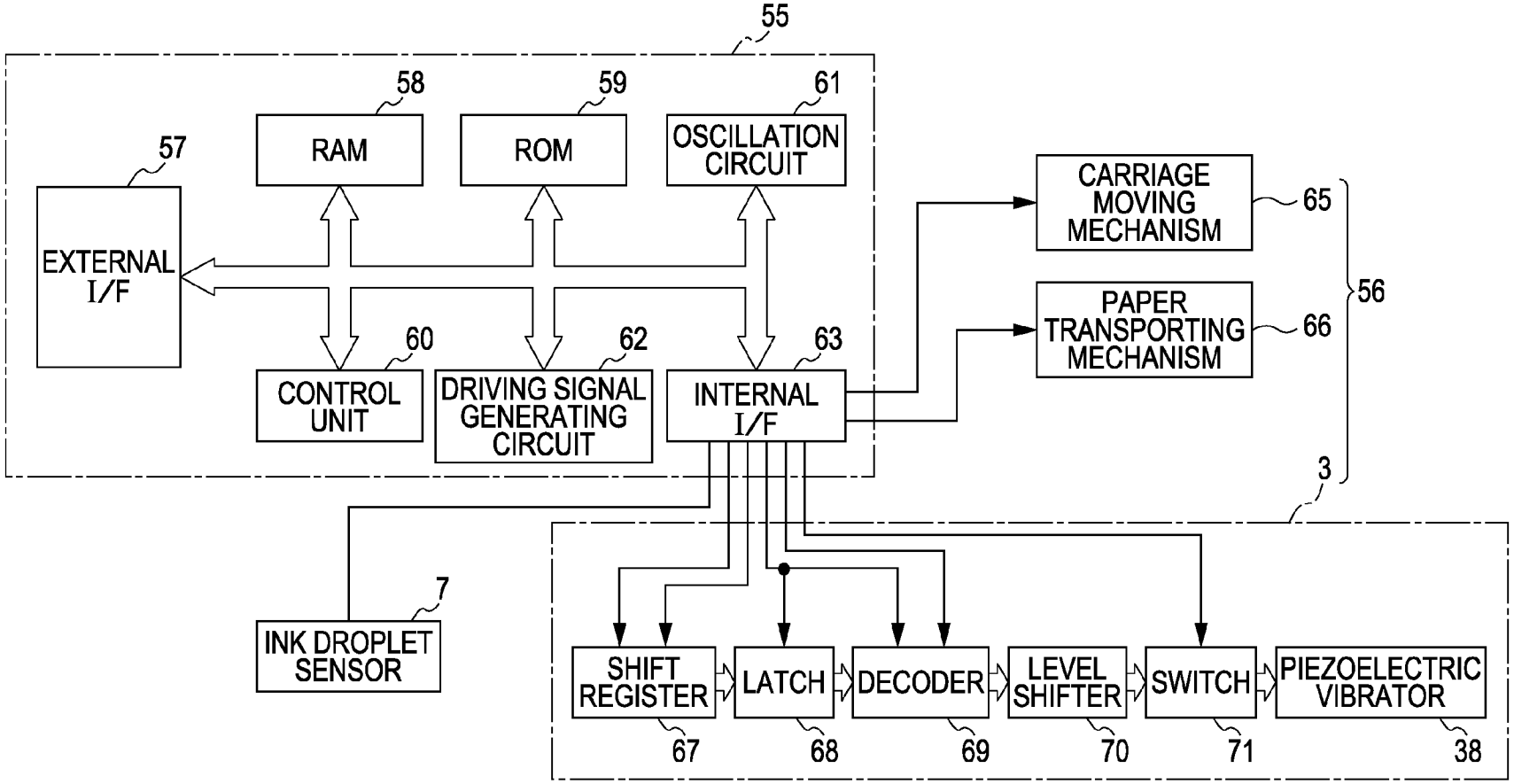
FIG. 5 is a block diagram showing the electrical configuration of the printer.
Figure 6:
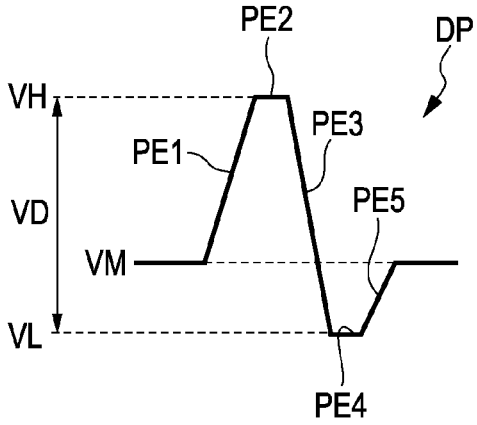
FIG. 6 is a diagram showing the configuration of an ejection pulse according to an embodiment of the invention.

FIG. 5 is a block diagram showing the electrical configuration of the printer 1. FIG. 6 is a diagram showing the configuration of an ejection pulse.

The printer 1 according to this embodiment includes a controller 55, a print engine 56, and an ink droplet sensor 7.

The printer controller 55 includes an external interface (external I/F) 57 to which print data or the like is input from an external device such as a host computer, a RAM 58 that stores various data and the like, a ROM 59 that stores a control program for various control processes or the like, a control unit 60 that performs overall control operations for each unit in accordance with the control program stored in the ROM 59, an oscillation circuit 61 that generates a clock signal, a driving signal generating circuit 62 that generates a driving signal to be supplied to the record head 3, an internal interface (internal I/F) 63 that is used for outputting the ejection data, the driving signal, or the like that is acquired from expanding print data for each dot to the record head 3.

The print engine 56 is configured by the record head 3, the carriage moving mechanism 65, and the paper transporting mechanism 66.

The record head 3 includes a shift register 67 in which the ejection data is set, a latch circuit 68 that latches the ejection data set in the shift register 67, a decoder 69 that interprets the ejection data transmitted from the latch circuit 68 and generates pulse selecting data, a level shifter 70 that serves as a voltage amplifier, a switching circuit 71 that controls supply of the driving signal to the piezoelectric vibrator 38, and the piezoelectric vibrator 38.

The control unit 60 expands the print data transmitted from the external device in the ejection data corresponding to the dot pattern thereof and transmits the ejection data to the record head 3. Then, from the record head 3, ejection of ink droplets D is performed based on the received ejection data.

In addition, the control unit 60 serves as a flushing processing unit that performs a flushing process based on a flushing condition that is stored in the ROM 59. The flushing process is a process for preventing nozzle clogging by discharging ink L having increased viscosity or air bubbles from the inside of each nozzle 47 of the record head 3. In the flushing process, ejection of ink droplets D of a predetermined times is performed from each nozzle 47 toward the cap member 15.

As the flushing process, there is a flushing process that is performed before a recording operation of the record head 3 after power of the printer 1 is turned on, that is, so-called a before-print flushing process. In the before-print flushing process, for example, it is configured to eject ink droplets D 3000 to 5000 times from all the nozzles 47. The flushing condition is stored in the ROM 59.

For setting the number of times of ejection in the before-print flushing process, a case (a worst condition) where power is not input to the printer 1 for several months is supposed. Thus, the number of times of ejection that can dissolve the nozzle clogging by discharging the ink L having increased viscosity from all the nozzles 47 even in such a case is set.

The above-described number (the flushing condition) of times of ejection is an initial value that is set at a time when the power is input to the printer 1. Thus, when an actual flushing process is performed, the number of times is configured to be changed to an optimal number of times.

Other than the before-print flushing, there is so-called a regular flushing process that is performed during a recording operation of the record head 3. In addition, there are a sheet-feeding-time flushing process that is performed at a time when a recording sheet is supplied toward the record head 3 and a sheet-discharging-time flushing process that is performed right after a recording sheet is discharged.

In the regular flushing process, the sheet-feeding-time flushing process, or the sheet-discharging-time flushing process, the initial value (the flushing condition) for the number of times of ejection is set in the range of several tens of times to several hundreds of times (for example, 144 times).

In addition, in the regular flushing process, a time interval (regular flushing time interval) for performing the regular flushing process is also set as the flushing condition. The initial value for the time interval, for example, is set to 10 seconds.

To the driving signal generating circuit 62, data representing the change amount of a voltage value of the ejection pulse supplied to the piezoelectric vibrator 38 of the record head 3 and a timing signal that defines a timing for changing the voltage value of the ejection pulse are input. Then, the driving signal generating circuit 62 generates a driving signal, for example, including an ejection pulse DP as shown in FIG. 6 based on the above-described data and the timing signal.

The ejection pulse DP is constituted by a first charging element PE1 that increases the electric potential at a relatively gentle gradient from a reference electric potential VM to a highest electric potential VH, a first hold element PE2 that maintains the highest electric potential VH for a predetermined time, a discharging element PE3 that decreases the electric potential at a steep gradient from the highest electric potential VH to a lowest electric potential VL, and a second hold element PE4 that maintains the lowest electric potential VL for a short time, and a second charging element PE5 that returns the electric potential from the lowest electric potential VL to the reference electric potential VM.

This ejection pulse DP is set to a driving voltage VD (a difference between the highest electric potential VH and the lowest electric potential VL) for which the liquid amount of the ink droplets D ejected from the nozzle 47 is equal to a designed liquid amount. In addition, the waveform of the ejection pulse DP is not limited to the waveform shown as an example, and any waveform may be used as the waveform of the ejection pulse.

When the ejection pulse DP is applied to the piezoelectric vibrator 38, the ink droplets D are ejected as follows. When the first charging element PE1 is supplied to the piezoelectric vibrator 38, the piezoelectric vibrator 38 is contracted, and accordingly, the pressure chamber 46 is expanded. After the expanded state of the pressure chamber 46 is maintained for a very short time, the discharging element PE3 is applied so as to rapidly expand the piezoelectric vibrator 38. Accordingly, the volume of the pressure chamber 46 is contracted below a reference volume (the volume of the pressure chamber 46 in a case where the reference electric potential VM is applied to the piezoelectric vibrator 38), and thus, the meniscus exposed to the nozzle 47 is suddenly pressed toward the outside thereof. Accordingly, the ink droplets D of a predetermined liquid amount are ejected from the nozzle 47. Thereafter, the second hold element PE4 and the second charging element PE5 are sequentially supplied to the piezoelectric vibrator 38. Thus, the volume of the pressure chamber 46 is returned to the reference volume, so that vibration of the meniscus accompanied with the ejection of the ink droplets D can be converged in a short time.

Figure 7:
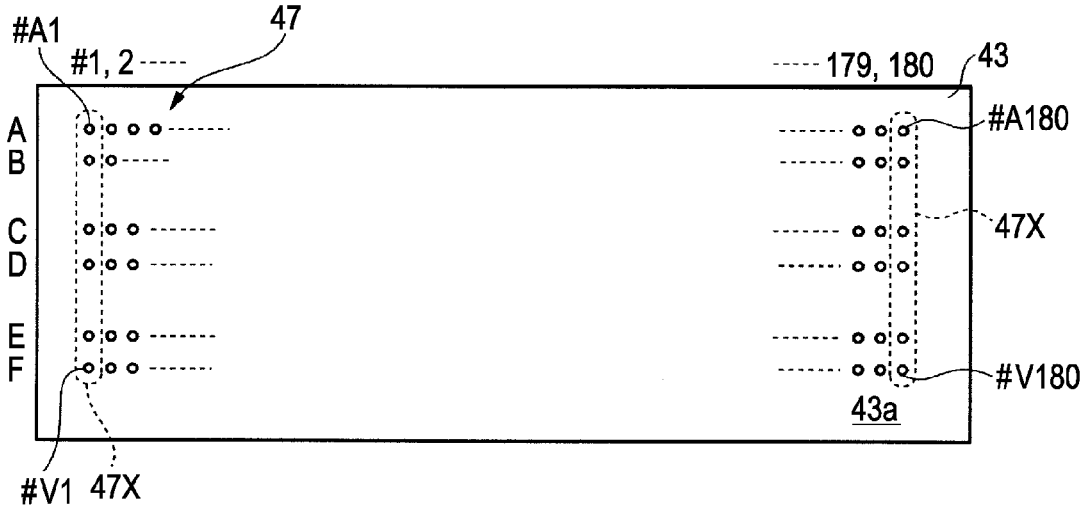
FIG. 7 is a schematic diagram showing nozzles formed on a nozzle opening face according to an embodiment of the invention.

FIG. 7 is a schematic diagram showing nozzles 47 formed on the nozzle opening face 43*a*.

On the nozzle opening face 43*a*, 6 rows×180 nozzles 47 (a total of 1080) are formed. Here, the rows of the nozzles are denoted by A to F, and nozzle numbers in the rows of the nozzles are denoted by 1 to 180.

All the 1080 nozzles 47 are configured to be able to eject ink droplets D. Among there nozzles, the states of increased viscosity of the ink droplets D are detected by ink droplets D (one droplet from each nozzle 47X) ejected from nozzles 47 (#A1, A180, By, B180 . . . F1, F180: hereinafter, these nozzles are referred to as target nozzles 47X) that are located in both ends (#1 and #180) of each of the rows A to F of the nozzles toward the ink droplet sensor 7 (the cap member 15).

The reason for detecting the states of the increased viscosity of the ink L by using the ink droplets D ejected from the target nozzles 47X is that ink L in the target nozzles 47X increases in viscosity (dried) the most easily of all the nozzles 47.

Since, for a nozzle located in the central area of the nozzle opening face 43*a*, there is a plurality of other nozzles 47 (meniscuses of the ink L) in the vicinity thereof, the degree of humidity therein becomes high, and accordingly, ink in the nozzle is not easily dried. However, for the target nozzles located in an outer peripheral area, other nozzles 47 are not located on the outer side of the target nozzles 47X, and thus the degree of humidity therein becomes lower than that of the central area or the like. Accordingly, ink in the target nozzles can be easily dried.

The printer 1 having the above-described configuration is configured to perform a flushing process (the regular flushing process) for every predetermined time period during a recording (printing) process for a recording sheet.

When the regular flushing process is performed, first, the states of increased viscosity of the ink L (ink droplets D) in the target nozzles 47X are detected. Then, the flushing condition (a time interval of the regular flushing process and the number of droplets ejected from each nozzle 47 in the regular flushing process) for the regular flushing process is changed based on the result of the detection.

Thereafter, it is controlled that ink droplets D are continuously ejected (flushing-processed) from all the nozzles 47.

Hereinafter, a case where the regular flushing process is performed will be described.

Figure 8:
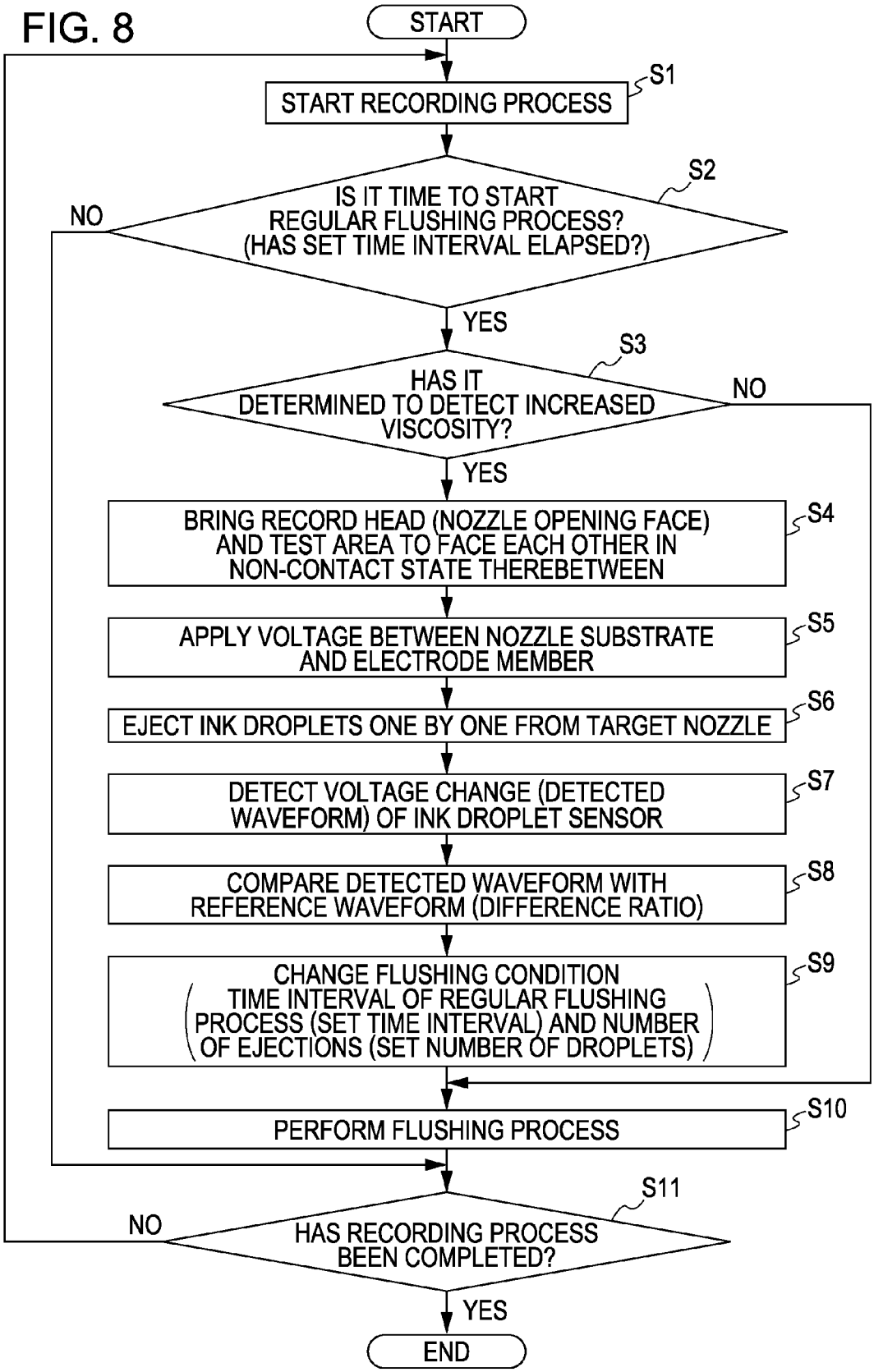
FIG. 8 is a flowchart showing a flushing method according to an embodiment of the invention.

FIG. 8 is a flowchart showing a flushing process using a flushing method according to an embodiment of the invention, that is, a flushing process using the ink droplet sensor 7.

Figure 9A:
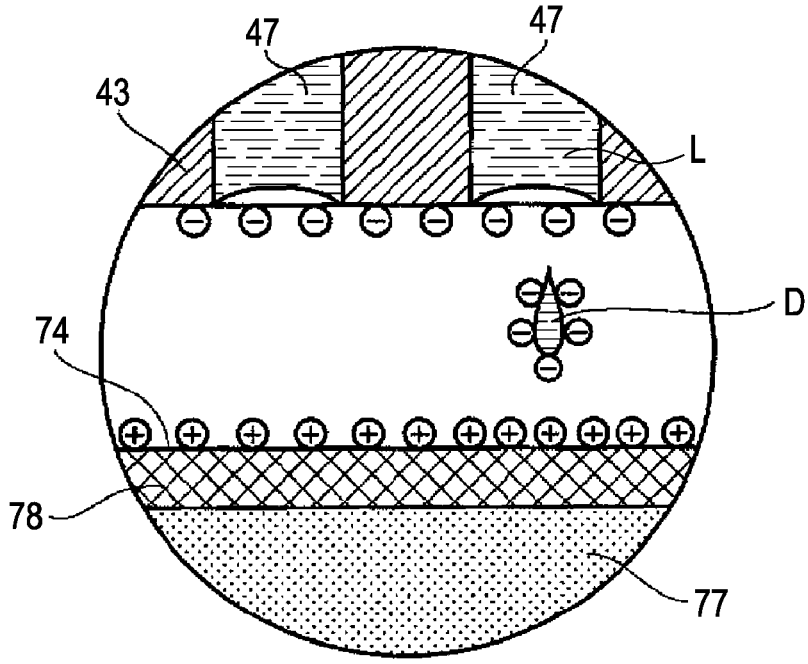
FIGS. 9A and 9B are schematic diagrams showing a principle of generating an induced voltage by electrostatic induction.
Figure 9B:
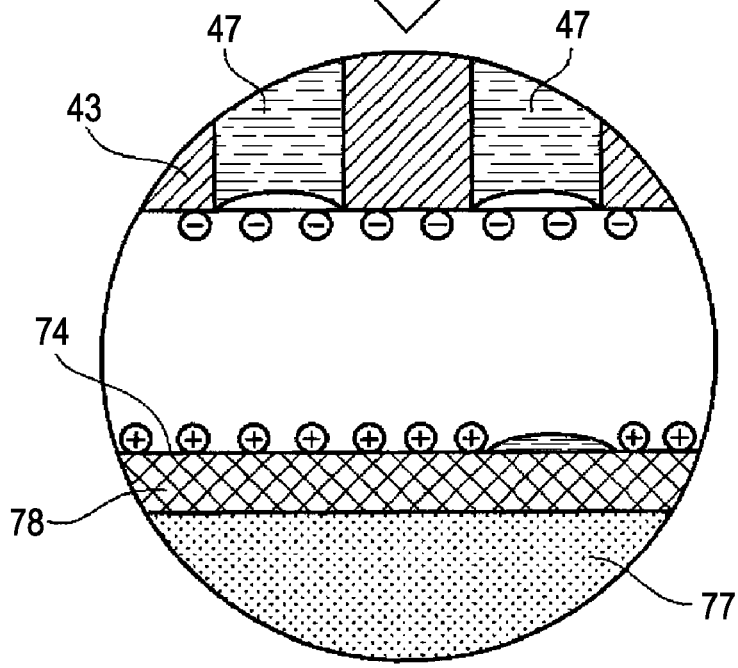

FIGS. 9A and 9B are schematic diagrams showing a principle of generating an induced voltage by electrostatic induction. FIG. 9A is a diagram showing a state right after ejection of the ink droplets D. FIG. 9B is a diagram showing a state that the ink droplets D land in a test area 74 of the cap member 15.

Figure 10:
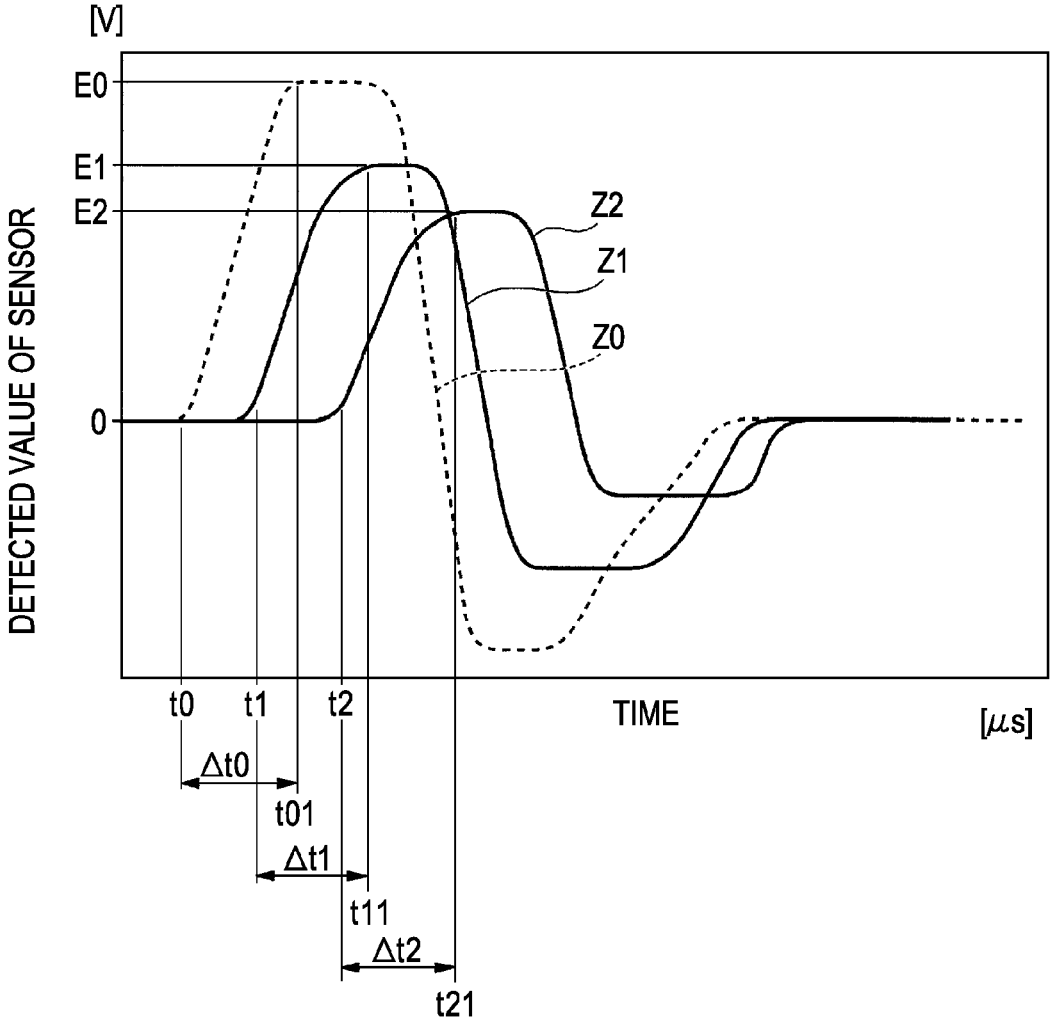
FIG. 10 is a diagram showing an example of the waveform of a detected signal that is output from the ink droplet sensor.

FIG. 10 is a diagram showing an example of the waveform of a detected signal that is output from the ink droplet sensor 7.

FIG. 11 is a table showing changed contents of the flushing condition.

When the print data is transmitted from an external device, the control unit 60 expands the print data in ejection data corresponding to the dot pattern and transmits the ejection data to the record head 3. Then, the record head 3 performs a recording (printing) process, that is, ejection (the fluid ejecting process) of ink droplets D for a recording sheet based on the received ejection data (Step S1).

Then, when a time (set time: a time interval of performing the regular flushing process) set in advance elapses during the recording process (Step S2), the recording process is stopped, and the regular flushing process is started.

In the regular flushing process, first, it is determined whether detection of the state of increased viscosity of the ink droplets D (ink L) ejected from the nozzle 47 is to be performed (Step S3). In the initial setting (at the start of the recording process), it is set in advance that detection of the state of increased viscosity is performed, and detection of the state of increased viscosity is not performed only in a case where a predetermined condition is satisfied.

When detection of the state of increased viscosity is to be performed, the record head 3 is moved to the home position so as to be positioned above the cap member 15 by driving the carriage 4. Then, the nozzle opening face 43*a* of the record head 3 and the test area 74 (the electrode member 78) are brought to closely face each other in a non-contact state by lifting the cap member 15 using a lift mechanism not shown in the figure. (Step S4).

Then a voltage is applied between the nozzle substrate 43 and the electrode member 78 by the voltage applying circuit 75 (Step S5).

Then, the piezoelectric vibrator 38 of the target nozzle 47X is driven by using the ejection pulse DP in a state that the voltage is applied between the nozzle substrate 43 and the electrode member 78, and ink droplets D are ejected from any one nozzle (for example, #A1) among the target nozzles 47X (Step S6).

In such a case, since the nozzle substrate 43 is negatively charged, as shown in FIG. 9A, a part of negative charges in the nozzle substrate 43 are moved to the ink droplets D. Accordingly, the ejected ink droplets D are negatively charged. Then, as the ink droplets D approach the test area 74 of the cap member 15, positive charges (the surface of the electrode member 78) in the test area 74 increase by electrostatic induction.

Accordingly, the voltage value between the nozzle substrate 43 and the electrode member 78 becomes higher than the initial voltage value for a case where the ink droplets D are not ejected, due to the voltage induced by the electrostatic induction.

Thereafter, as shown in FIG. 9B, when the ink droplets D land in the electrode member 78, positive charges in the electrode member 78 are neutralized by the negative charges of the ink droplets D. Accordingly, the voltage value between the nozzle substrate 43 and the electrode member 78 becomes lower than the initial voltage value.

Thereafter, the voltage value between the nozzle substrate 43 and the electrode member 78 returns to the initial voltage value.

Accordingly, as shown in FIG. 10, the detected waveform output from the ink droplet sensor 7 becomes a waveform in which the voltage value, first, increases, the voltage value decreases until it becomes lower than the initial voltage value, and then, the voltage value returns to the initial voltage value.

As described above, a voltage change in a case where the ink droplets D are ejected from the target nozzle 47X is detected by using the ink droplet sensor 7 (Step S7).

However, when the ink droplets D have increased viscosity, the amount of ejection (the liquid amount) decreases, an ejection timing of the ink droplets D are slowed down, or the ejection speed of the ink droplets D decreases, compared to a normal state (a case where the viscosity of the ink droplets does not increase) even in a case where a same ejection pulse DP is used.

Accordingly, as shown in FIG. 10, a detected signal (detected voltage waveforms Z1 and Z2) for a case where the viscosity increases has the amplitude of the waveform and a timing of the change of the waveform that are different from those of a detected signal (a reference voltage waveform Z0) for a case where the viscosity does not increase.

In addition, as the reference voltage waveform Z0, a detected signal for a case where the viscosity does not increase may be stored in advance, or a detected signal in an ink ejecting process performed after ink having increased viscosity is sucked from the nozzle 47 by a suction unit not shown in the figure may be stored. Furthermore, another method may be used as long as a detected signal for a case where the viscosity does not increase can be stored.

In particular, when the amount of ejection (the liquid amount) decreases due to increased viscosity, the highest voltage values E1 and E2 of the detected voltage waveforms Z1 and Z2 output from the ink droplet sensor 7 become smaller than the highest voltage value E0 of the reference voltage waveform Z0.

In addition, when the timing of ejection of the ink droplet D is slowed down due to the increased viscosity, time intervals t1 and t2 from a time when the ejection pulse DP is applied (time 0) to a time when the ink droplet D is departed (a change of a voltage value is generated) from the nozzle plate 43 become longer than the time interval t0 for a case where the viscosity does not increase.

In addition, when the speed of ejection of the ink droplet D is slowed down due to the increased viscosity, time intervals Δt1 and Δt2 from a time when the ink droplet D is ejected (a change of the voltage value is generated: time t0, t1, and t2) to a time when the ink droplet lands (the highest voltage value is reached: time t01, t11, and t21) become longer than the time interval Δt0 for a case where the viscosity does not increase.

Accordingly, the state of increased viscosity of the ink L (the ink droplet D) can be acquired by comparing the detected voltage waveforms Z1 and Z2 output from the ink droplet sensor 7 with the reference voltage waveform Z0.

In particular, the ratios of differences between the detected voltage waveforms Z1 and Z2 and the reference voltage waveform Z0 to the reference voltage waveform Z0 are acquired. When the detected voltage waveform Z1 is described as an example, the following ratios are acquired.

ratio RE=(E1−E0)/E0 ratio Rt=(t1−t0)/t0 ratio RΔt=(Δt1−Δt0)/Δt0

It is preferable that all the three ratios are acquired. However, acquisition of all the ratios is not an essential condition. Thus, only an arbitrary ratio among the ratios may be acquired. In such a case, a ratio for which precision of detection can be acquired in accordance with the kind of the ink L may be selected.

As described above, the state of increased viscosity of the ink L in the target nozzle 47X can be acquired (Step S8).

As described above, there are 12 (6 rows×2) target nozzles 47X in the record head 3, and the states of increased viscosity of the ink L in all the target nozzles 47X may be acquired by sequentially ejecting ink droplets D one by one from the target nozzles 47X toward the ink droplet sensor 7.

When the states of increased viscosity of the ink L in all the target nozzles 47X are acquired, the ink L (ink droplet D) having the most increased viscosity is selected, and information on the ink L having the worst state of increased viscosity is used for processes thereafter.

The frequency (time interval) of the regular flushing process or the number of droplets ejected from each nozzle 47 in the regular flushing process is set in advance in consideration of a case where the state of increased viscosity of the ink L inside the nozzle 47 is the worst.

However, in most of the cases, the actual state of increased viscosity of the ink L is not in the worst state. Thus, it is possible to suppress the amount of ink L wasted in the regular flushing process can be suppressed to be minimal by detecting the state of increased viscosity of the ink L and changing the flushing condition such as the time interval of the regular flushing process or the number of ink droplets based on the detected state of increased viscosity.

Thus, the flushing condition is changed in accordance with the state of increased viscosity of ink L that is the most increased among states of increased viscosity of the ink L in the target nozzles 47X which have been acquired in Step S8 (Step S9).

As a method of determining the change of the flushing condition, a table shown in FIG. 11 is stored in the ROM 59 in advance, and the time interval of a regular flushing process or the number of ejected droplets ejection is changed in accordance with the difference ratios (ratio RE, ratio Rt, and ratio RΔt) acquired in Step S8. The concrete figures included in the table shown in FIG. 11 are only examples.

Then, when the flushing condition is changed, a flushing process in which ink droplets D are ejected from all the nozzles 47 simultaneously and continuously based on the new flushing condition is performed (Step S10).

Then, when the regular flushing process is completed, the process returns to the recording process. In the recording process, whether the recording process is completed (Step S10) and the regular flushing process is to be performed (Step S2) are determined repeatedly. In other words, during the period, a plurality of the regular flushing processes (Steps S3 to S10) is performed.

As described above, the time interval (set time interval) for the regular flushing process and the number of ejected droplets (set number of droplets) are set in advance to values for which ink L having increased viscosity can be removed even when the ink L is in the supposed worst state of increased viscosity. For example, the set time interval is set to about 10 seconds, and the set number of droplets is set to about 30 droplets.

When the increased viscosity of the ink L is very little as in a case where the ink cartridge 6 is replaced right before, the difference ratios (ratio RE, ratio Rt, and the ratio RΔt) acquired in Step S8, for example, become smaller than 5%. Thus, in Step S9, the set time interval is extended to 10.5 seconds, and accordingly, the number of set droplets decreases to 29 droplets.

Even in a case where the viscosity of the ink L increases as time elapses, when the difference ratios that are acquired in Step S8 are smaller than 5%, the set time interval is extended slowly and, for example, can be slowly extended to several minutes. In addition, the set number of droplets slowly decreases and can decrease to the minimum of one droplet.

When the viscosity of the ink L increases further and the difference ratios acquired in Step S8, for example, are equal to or lager than 5% and are smaller than 10%, the set time interval and the number of set droplets are not changed in Step S9, and the set time interval and the set number of droplets that have been previously set are maintained. In other words, when the set time interval and the set number of droplets that have been previously set are 22.5 seconds and 5 droplets, the settings are maintained as long as the difference ratios acquired next are equal to or larger than 5% and are smaller than 10%.

Then, when the viscosity of the ink L increases further and the difference ratios acquired in Step S8 are equal to or lager than 10%, the set time interval is decreased by 0.5 second in Step S9, and the number of set droplets increases by one droplet.

As described above, the flushing condition (the time interval of the regular flushing process and the number of ejected droplets) for the regular flushing process is changed in accordance with the state of increased viscosity of the ink L.

In addition, the reason why the set time interval and the set number of droplets are configured to be maintained in a case where the difference ratio is equal to or larger than 5% and is smaller than 10% is that the acquired difference ratios are experimentally presumed to converge in the range of 5% to 10%. The ratio of 5% to 10% is a supposed ratio in this embodiment. When the acquired ratio is within this range of the ratio, the state of increases viscosity can be dissolved by performing the regular flushing process. Accordingly, the amount of consumption of ink is small, and a good printing process can be continued without deteriorating the print quality caused by the increased viscosity.

Thus, when a state that the ratio acquired in Step S8 is equal to or larger than 5% and is smaller than 10% is continued for a predetermined time, the frequency of performing the process (Steps S4 to S9) for detecting increased viscosity of the ink L and changing the flushing condition may be decreased. In other words, without performing the process for detecting the increased viscosity of the ink L and changing the flushing condition for each regular flushing process, it may be changed that the process (Steps S4 to S9) for detecting the increased viscosity of the ink L and changing the flushing condition, for example, is performed once for every five regular flushing processes.

Whether the process (Steps S4 to S9) for detecting the increased viscosity of the ink L and changing the flushing condition is to be performed in the regular flushing process is determined in Step S3.

As described above, according to the flushing method for the printer 1 according to this embodiment, the regular flushing process can be performed by using a flushing condition appropriate to a supposed state of viscosity that is not the worst state.

In other words, a general regular flushing process is performed based on a flushing condition that is set in consideration of a state (for example, a state of increased viscosity having a difference ratio of 10% or more) that the ink L is the most increased. However, in the printer 1 according to this embodiment, when the viscosity of ink droplets D (ink L) ejected from the nozzles 47 changes, the time interval of the regular flushing process (the set time interval) and the number of ejected droplets (set number of droplets) in the regular flushing process are changed. Accordingly, the regular flushing process that is optimized to the viscosity of the ink L can be performed.

As a result, the amount of ink L that is wasted in an unnecessary flushing process can be suppressed while generation of nozzle clogging can be avoided assuredly. In addition, the throughput of the recording process can be improved in accompaniment with a decrease of the frequency of the regular flushing process or the like.

In the above-described embodiment, as the flushing condition, a case where both the time interval of the regular flushing process and the number of the ejected droplets are changed (optimized) has been described. However, any one thereof only may be configured to be changed.

In addition, the ejection pulse DP may be configured to be changed. In other words, as the initial value of the ejection pulse DP, an ejection pulse DP that is used in the recording (printing) process is set. Then, the driving voltage VD of the ejection pulse DP is changed in accordance with the state (the detected signal of the ink droplet sensor 7) of increased viscosity of the ink droplets D ejected from the target nozzles 47X in the flushing process (above-described Step S9). When the difference ratio acquired in Step S8 is equal to or larger than 5% and is smaller than 10%, the driving voltage VD is changed to decrease. On the other hand, when the difference ratio is larger than 10%, the driving voltage VD is changed to increase.

Accordingly, the amount of the ink L wasted in the regular flushing process can be suppressed to be a minimum level. In addition, occurrence of nozzle clogging can be prevented.

Next, a process for optimizing the time interval of the regular flushing process that is performed in advance before the recording process (fluid ejecting process) will be described.

Figure 12:
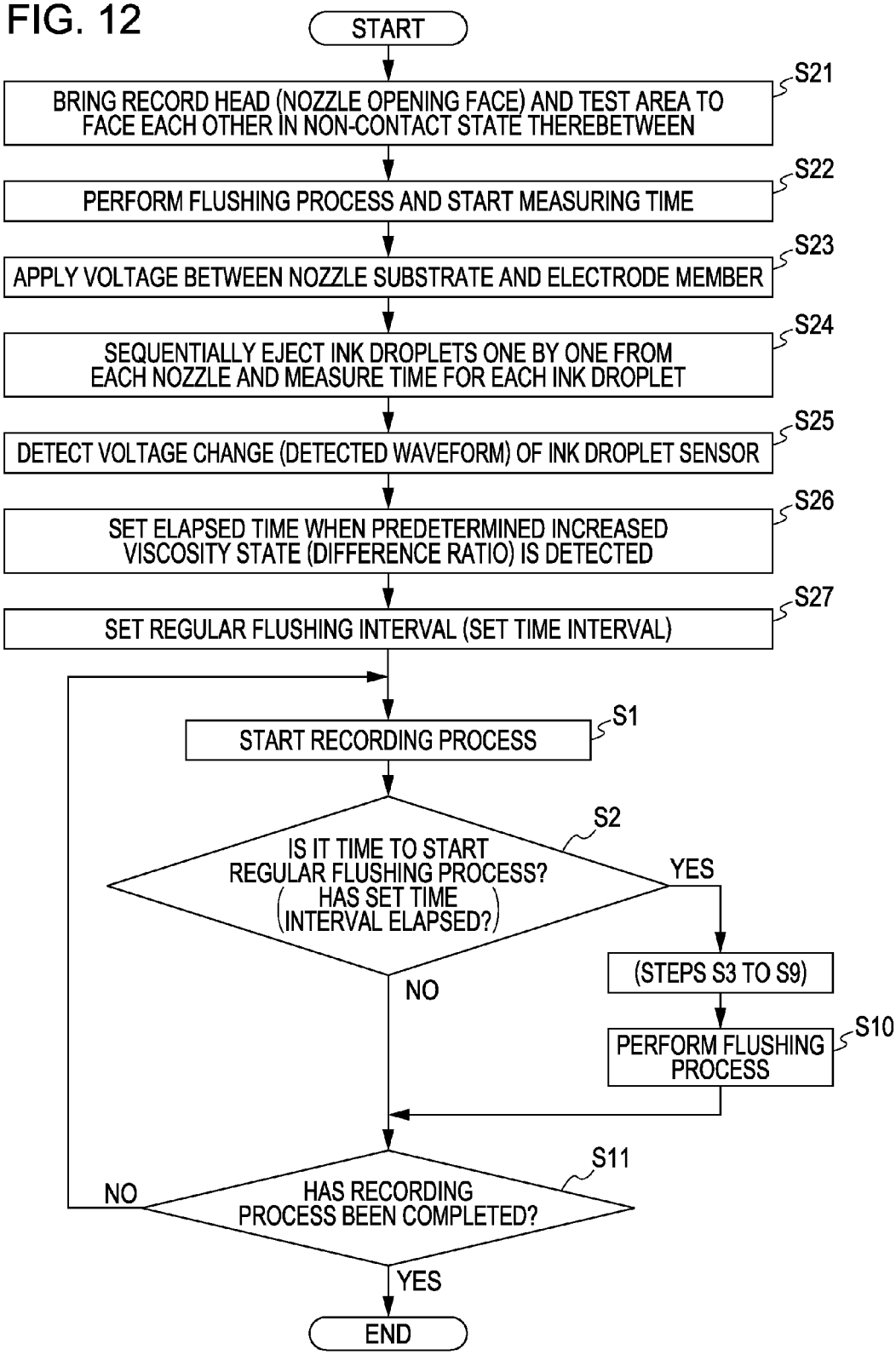
FIG. 12 is a flowchart showing a flushing method according to a second embodiment of the invention.

FIG. 12 is a flowchart showing a flushing method according to a second embodiment of the invention, that is, a flushing process using the ink droplet sensor 7.

In the flushing method shown in FIG. 8, as the time interval of the regular flushing process, the set time interval is set to about 10 seconds in advance. On the other hand, in the flushing method shown in FIG. 12, the set time interval is optimized before the recording process.

In other words, when print data is transmitted from an external device after turning the power on or a non-recording (printing) state maintained for a long time, the control unit 60, before a recording process, performs a process for optimized setting of the set time interval shown below.

First, in the process for optimized setting of the set time interval, the record head 3 is positioned above the cap member 15, and the nozzle opening face 43*a* of the record head 3 and the test area 74 (the electrode member 78) are brought to face each other in a non-contact state (Step S21).

Next, a before-print flushing process in which ink L having increased viscosity is discharged is performed by ejecting ink droplets D from all the nozzles 47 of the record head 3 toward the cap member 15. Then, when the before-print flushing process is completed, time measuring is started by using a timer inside the control unit 60 (Step S22).

Then, a voltage is applied between the nozzle substrate 43 and the electrode member 78 by the voltage applying circuit 75 (Step S23). Subsequently, in the state that the voltage is applied, the piezoelectric vibrator 38 of an arbitrary one nozzle 47 is driven by using the ejection pulse DP, so that ink droplets D are ejected from the nozzle 47 (Step S24).

In Step S24, right after starting time measuring by using the timer inside the control unit 60, from an arbitrary one nozzle (not limited to the target nozzle 47X) among all the nozzles 47, the ink droplets D are sequentially ejected one by one at a predetermined time interval.

For example, in order of #A1, #A2, #A3, . . . of the nozzle 47, the ink droplets are ejected one by one at a time interval of 0.5 second. In other words, one ink droplet D is ejected from #A1 of the nozzle 47 when 0.5 second elapses after completion of the before-print flushing process, one ink droplet D is ejected from #A2 when 1.0 second elapses after the completion of the before-print flushing process, and one ink droplet is ejected from #A3 when 1.5 seconds elapse after the completion of the before-print flushing process. In such a case, the time measuring is performed by the timer inside the control unit 60.

Accordingly, from the ink droplet sensor 7, voltage waveforms for each ink droplet D can be acquired (Step S25).

Right after the before-print flushing process is completed, the ink L (ink droplets D) inside the nozzles 47 is in a state that the viscosity is not increased (for a normal case). In other words, from the ink droplet sensor 7, the above-described reference voltage waveform Z0 can be acquired.

However, for example, when 10 seconds or more elapse after the completion of the before-print flushing process, the viscosity of the ink L inside the non-ejection nozzles 47 slowly increases. Accordingly, the detected voltage waveform of the ink droplet sensor 7 for the ink droplet D ejected from #A20 of the nozzle 47 or the like becomes the waveform (for example, the detected voltage waveform Z1, Z2, or the like) for a case where the viscosity increases.

As described above, while an elapsed time from the before-print flushing process is measured, the state of increased viscosity of the ink droplets D (ink L) ejected from the nozzles 47 are detected (Step S26).

In other words, a time required for the state of increased viscosity of the ink droplets D (ink L) ejected from the nozzles 47 to reaching a predetermined state of increased viscosity (for example, the difference rate is 5 to 10%) is acquired. Here, a calculation process for the difference ratio is the same as that in Step S8.

Accordingly, a time until the state of increased viscosity of the ink droplets D (ink L), that is, the difference ratio, for example, becomes 7% is measured, and the time is set as the time interval (set time) for the regular flushing process of the flushing condition (Step S28).

For example, when the ink droplet D ejected from #A40 of the nozzle 47 becomes the difference ratio of 7%, 20.0 seconds is set as the time interval of the regular flushing process.

As described above, before the recording process is started, an elapsed time until the state of increased viscosity of the ink droplets D (ink L) becomes a predetermined state is measured, and the time is set as the time interval of the regular flushing process. Accordingly, the time interval of the regular flushing process can be optimally set from the start of the recording process. Thus, in the above-described Steps S3 to S9, only environmental changes (a temperature change and the like) occur thereafter are needed to be responded to, and thereby a recording process and a regular flushing process can be performed efficiently.

In addition, ink droplets D are sequentially ejected one by one from an arbitrary nozzle 47 at a predetermined time interval right after the before-print flushing process. Accordingly, the time interval of the regular flushing process can be optimally set in a short time.

In addition, in the above-described embodiment, although various limitations are applied as an appropriate concrete example of the invention, the invention is not limited thereto. Thus, the embodiment may be changed variously based on the claims.

For example, in the above-described embodiment, although a regular flushing process has been described, the application of the invention is not limited thereto. Thus, the invention may be applied to flushing processes of other types. For example, the invention may be applied to a before-print flushing process that is performed before the recording (printing) process, or a paper-feeding-time flushing process or a paper-discharging-time flushing process that is performed at a paper feeding process or a paper discharging process.

In the above-described embodiment, a case where a nozzle, of which ink L has the most increased viscosity, among the plurality of target nozzles 47X is selected and a post-process (changing the flushing condition) is performed has been described. However, the invention is not limited thereto.

The flushing condition may be configured to be changed for each row A to F of the nozzles. When different kinds of ink (for example, color ink of six colors) are ejected for each row of the nozzles, it is possible to perform an optimized flushing process corresponding to the kind of the ink. Since compositions of ink of each color are different from one another, the states of increased viscosity are different for each color. Thus, it is possible to suppress the amount of wasted ink to a minimum level and to prevent occurrence of nozzle clogging even in a case where a plurality of kinds of ink is ejected, by optimizing the flushing condition for each row of the nozzles.

In addition, in the above-described embodiment, a case where nozzles 47 located on both ends of the rows A to F of the nozzles are set as the target nozzles 47X has been described. However, the invention is not limited thereto.

For example, when there is a nozzle 47 that has not ejected even one ink droplet D after the previous regular flushing process, the nozzle 47 may be configured as the target nozzle. In other words, the target nozzle may be changed for each regular flushing process.

In addition, in the above-described embodiment, an example in which the cap member 15 of the capping mechanism 14 is configured to be used as the liquid droplet receiving part has been described. However, the invention is not limited thereto, and a liquid droplet receiving part that is independently provided only for an ejection test may be disposed.

In addition, in the above-described embodiment, an example in which the electrode member 78 and the nozzle substrate 43 of the record head 3 are electrically connected to each other such that the electrode member 78 becomes a negative electrode and the nozzle substrate becomes a negative electrode has been described. However, the polarities of the electrode member 78 and the nozzle substrate 43 may be reversed.

In addition, in this embodiment, although the piezoelectric vibrator 38 having so-called a vertical vibration mode has been described as a pressure generating source, as an example, however, the invention is not limited thereto. For example, a piezoelectric vibrator that can vibrate in the direction (the direction of laminating the piezoelectric body and the internal electrode) of an electric field may be used as the pressure generating source. In addition, the piezoelectric vibrator is not limited to a piezoelectric vibrator that is formed as a unit for each row of nozzles. Thus, the piezoelectric vibrator may be installed for each pressure chamber 46 as so-called a piezoelectric vibrator having a bending vibration mode. Furthermore, the pressure generating source is not limited to the piezoelectric vibrator, and thus a pressure generating source of another type such as a heating element may be used as the pressure generating source.

In the above-described embodiment, although an ink jet printer (recording device) has been embodied as a fluid ejecting device, however, the invention is not limited thereto. Thus, the invention may be embodied as a fluid ejecting device that ejects or discharges a fluid (a liquid body in which particles of a function material are dispersed or a fluid such as a gel) other than ink.

For example, the liquid ejecting device may be a liquid body ejecting device that ejects a liquid body including a material such as an electrode material or a color material used for producing a liquid crystal display, an EL (electroluminescence) display, a surface emitting display, or the like in a dispersed or dissolved form, a fluid ejecting device that ejects a bioorganic material used for producing a bio chip, or a fluid ejecting device that ejects a fluid that is used as a precision pipette and becomes a test material.

In addition, the fluid ejecting device may be a fluid ejecting device that ejects a lubricant to a precision machine such as a clock or a camera in a pin-point manner, a fluid ejecting device that ejects a transparent resin liquid such as an ultraviolet-curable resin onto a substrate for forming a tiny hemispherical lens (optical lens) used in an optical communication element or the like, a fluid ejecting device that ejects, for example, an acid or alkali etching liquid for etching a substrate or the like, or a fluid ejecting device that ejects a gel.

In any type of the above-described fluid ejecting device, when there is a possibility that an ejected liquid (a liquid, a liquid body, or a fluid) has increased viscosity caused by dryness or the like, the invention may be applied to the fluid ejecting device.

The entire disclosure of Japanese Patent Application Nos. 2007-242467, filed Sep. 19, 2007, and 2007-315017, field Dec. 5, 2007 are expressly incorporated by reference herein.

What is claimed is:

1. A flushing method for a fluid ejecting device that prevents clogging of a nozzle by ejecting a fluid of a set number of droplets at each set time interval in a fluid ejecting process from the nozzle of a fluid ejecting head toward a fluid receiving part that is disposed to face a nozzle opening face of the fluid ejecting head in a state of non-contacting the nozzle opening face, the flushing method comprising:

applying an electric field between the nozzle opening face and the fluid receiving part;

ejecting the fluid from the fluid ejecting head toward the fluid receiving part;

detecting a voltage change based on electrostatic induction that occurs at a time when the fluid is ejected toward the fluid receiving part; and changing at least one between the set time interval and the set number of the droplets based on the voltage change.

2. The flushing method according to claim 1, wherein the changing of one between the set time interval and the set number of the droplets includes comparing a reference voltage waveform that is detected at a time when the fluid not having increased viscosity is ejected with a detected voltage waveform that is acquired by the detecting of the voltage change.

3. The flushing method according to claim 2, wherein at least one of a highest voltage value, a time interval from ejection of the fluid to generation of the voltage change, and a time interval from the generation of the voltage change to reaching the highest voltage value is compared in the comparing of the reference voltage waveform with the detected voltage waveform.

4. The flushing method according to claim 2, wherein the changing one between the set time interval and the set number of the droplets includes changing at least one between the set time interval and the set number of the droplets in accordance with a ratio acquired from the comparing of the reference voltage waveform with the detected voltage waveform.

5. The flushing method according to claim 4, wherein, when the acquired ratio is lower than a supposed ratio, at least one between the set time interval and the set number of the droplets is changed such that the set time interval is lengthened and the set number of the droplets is decreased, and wherein, when the acquired ratio is higher than the supposed ratio, at least one between the set time interval and the set number of the droplets is changed such that the set time interval is shortened and the set number of the droplets is increased.

6. The flushing method according to claim 1, wherein a nozzle that has not ejected a fluid after a previous flushing process or nozzles disposed on both ends of each of a plurality of nozzle rows are used as the nozzle that ejects the fluid toward the fluid receiving part in the ejecting of the fluid.

7. The flushing method according to claim 1, wherein, when the changing of one between the set time interval and the set number of the droplets is performed a plurality of times and detection results acquired in the changing of one between the set time interval and the set number of the droplets become approximately fixed, a frequency of performing the applying of the electric field to the changing of one between the set time interval and the set number of the droplets is decreased.

8. The flushing method according to claim 1, wherein, before the ejecting of the fluid, an electric field is applied between the nozzle opening face and the fluid receiving part, the fluid is ejected from the fluid ejecting head toward the fluid receiving part while a time from the previous flushing process is measured, a voltage change caused by electrostatic induction that occurs at a time when the fluid is ejected toward the fluid receiving part is detected, a time interval until the fluid ejected from the fluid ejecting head becomes predetermined viscosity is detected based on the voltage change, and the acquired time interval is set as the set time interval.

9. The flushing method according to claim 8, wherein, in the ejecting of the fluid from the fluid ejecting head toward the fluid receiving part, the fluid is sequentially ejected from nozzles of the fluid ejecting head at different timings.

10. A fluid ejecting device that performs a flushing process for preventing clogging of a nozzle by ejecting a fluid of a set number of droplets at each set time interval in a fluid ejecting process from the nozzle of a fluid ejecting head toward a fluid receiving part that is disposed to face a nozzle opening face of the fluid ejecting head in a state of non-contacting the nozzle opening face, the fluid ejecting device comprising:

a fluid detecting unit that applies an electric field between the nozzle opening face and the fluid receiving part and detects a voltage change based on electrostatic induction that occurs at a time when the fluid is ejected toward the fluid receiving part; and a flushing processing unit that ejects the fluid from the fluid ejecting head toward the fluid receiving part and changes at least one between the set time interval and the set number of the droplets based on the detection result of the fluid detecting unit.

11. The fluid ejecting device according to claim 10, wherein the flushing processing unit compares a reference voltage waveform that is detected by the fluid receiving part at a time when the fluid having non-increased viscosity is ejected from the fluid ejecting head and a detected voltage waveform that is detected at a time when the fluid having increased viscosity is ejected.

12. The fluid ejecting device according to claim 11, wherein the flushing processing unit compares at least one of a highest voltage value, a time interval from ejection of the fluid to generation of the voltage change, and a time interval from the generation of the voltage change to reaching the highest voltage value.

13. The fluid ejecting device according to claim 11, wherein the flushing processing unit changes at least one between the set time interval and the set number of the droplets in accordance with an acquired ratio.

14. The fluid ejecting device according to claim 13, wherein the flushing processing unit changes at least one between the set time interval and the set number of the droplets such that the set time interval is lengthened and the set number of the droplets is decreased when the acquired ratio is lower than a supposed ratio, and wherein the flushing processing unit changes at least one between the set time interval and the set number of the droplets such that the set time interval is shortened and the set number of the droplets is increased when the acquired ratio is higher than the supposed ratio.

15. The fluid ejecting device according to claim 10, wherein a nozzle that has not ejected a fluid after a previous flushing process or nozzles disposed on both ends of each of a plurality of nozzle rows are used as the nozzle that ejects the fluid toward the fluid receiving part.

16. The fluid ejecting device according to claim 10, wherein the flushing processing unit decreases a frequency of operating the fluid detecting unit when a plurality of acquired detection results becomes approximately fixed.

17. The fluid ejecting device according to claim 10, wherein the flushing processing unit, before the fluid ejecting process, ejects the fluid from the fluid ejecting head toward the fluid receiving part while measuring a time from the previous flushing process, acquires a time interval until the fluid ejected from the nozzle becomes predetermined viscosity based on the detection result of the fluid detecting unit, and sets the acquired time interval as the set time interval.

18. The fluid ejecting device according to claim 17, wherein the flushing processing unit sequentially ejects the fluid from nozzles of the fluid ejecting head at different timings.

* * * * *